US008192514B2

(12) United States Patent
Stadler et al.

(10) Patent No.: US 8,192,514 B2
(45) Date of Patent: Jun. 5, 2012

(54) FIXED BED COAL GASIFIER

(75) Inventors: Jacobus Andreas Stadler, Secunda (ZA); Eric Graham Van De Venter, Johannesburg (ZA); Paul Smit Baumann, Johannesburg (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 787 days.

(21) Appl. No.: 11/720,932

(22) PCT Filed: Nov. 30, 2005

(86) PCT No.: PCT/IB2005/053969

§ 371 (c)(1),
(2), (4) Date: Jan. 7, 2009

(87) PCT Pub. No.: WO2006/061738

PCT Pub. Date: Jun. 15, 2006

(65) Prior Publication Data

US 2009/0158658 A1 Jun. 25, 2009

(30) Foreign Application Priority Data

Dec. 8, 2004 (ZA) ..... 2004/9959

(51) Int. Cl.
*C10J 3/68* (2006.01)

(52) U.S. Cl. ..... 48/77; 48/76; 48/127.1; 48/127.9; 48/197 R; 48/203; 48/207; 48/210; 110/118

(58) Field of Classification Search ..... None
See application file for complete search history.

(56) References Cited

U.S. PATENT DOCUMENTS

| | | | | |
|---|---|---|---|---|
| 4,643,109 | A | 2/1987 | Meyer | |
| 4,764,184 | A * | 8/1988 | Meyer | 48/77 |
| 5,133,780 | A * | 7/1992 | Sadowski | 48/66 |
| 5,230,716 | A | 7/1993 | Notestein | |

FOREIGN PATENT DOCUMENTS

| | | | |
|---|---|---|---|
| DE | 133817 | A1 | 1/1979 |
| DE | 3700936 | A1 | 7/1987 |
| WO | 99/10094 | A | 3/1999 |

OTHER PUBLICATIONS

International Search Report and Written Opinion for PCT/IB2005/053969 (mailed Jul. 6, 2006).

Kai, Wang, Brief Analysis on the structure of fine-coal pressurized gasifiers. Coal Chemicals, 1987, No. 1.

* cited by examiner

*Primary Examiner* — Kaity V. Handal

(74) *Attorney, Agent, or Firm* — Faegre Baker Daniels LLP

(57) ABSTRACT

A fixed bed coal gasifier (300) includes a coal gasification chamber with a coal lock above the chamber. A static coal distribution device inside the gasification chamber includes a hollow coal distributor which flares downwardly outwardly with a skirt depending downwardly from an inside of the coal distributor so that a gas collection zone is defined between the skirt and the coal distributor. The gasifier (300) has an ash discharge outlet (606) and a rotatable grate (600) above the outlet (606). The rotatable grate (600) includes at least one upwardly projecting finger or disturbing formation (500) to disturb the ash bed formed in use above and around the grate (600).

15 Claims, 7 Drawing Sheets

FIXED BED COAL GASIFIER

THIS INVENTION relates to a fixed bed coal gasifier and to a method of operating a fixed bed coal gasifier.

Fixed bed coal gasifiers, such as fixed bed dry bottom gasifiers, are also known as moving bed gasifiers or moving bed dry ash gasifiers.

According to a first aspect of the invention, there is provided a fixed bed coal gasifier, which includes a normally upright cylindrical wall defining a coal gasification chamber in which coal, in the form of a fixed coal bed, can be gasified to produce synthesis gas as well as ash in an ash bed below the coal bed;

a coal lock above the chamber, the coal lock having a more-or-less centrally located coal discharge opening which is in communication with the coal gasification chamber and a displaceable closure member for closing off the coal discharge opening, the closure member being displaceable between a closed position in which it closes off the coal discharge opening and an open position in which the coal discharge opening is uncovered or open so that coal can pass under gravity from the coal lock through the coal discharge opening into the coal gasification chamber;

a static coal distribution device inside the coal gasification chamber, the static coal distribution device including a hollow coal distributor having an upper open end spaced from the coal discharge opening and which flares downwardly outwardly from its upper end to a lower open end thereof and with no static coal distribution device being provided between the upper end of the coal distributor and the coal discharge opening, apart possibly from the closure member; a skirt depending downwardly from the inside of the coal distributor so that a gas collection zone is defined between the skirt and the coal distributor, with the top of the gas collection zone being closed off while the bottom thereof is in communication with the coal gasification chamber; and at least one gas outlet in the coal distributor, with the gas outlet being in communication with the gas collection zone, a first coal passageway thus being defined between the coal distributor and the cylindrical wall while a second coal passageway is provided along the inside of the skirt;

a gas withdrawal conduit leading from the gas outlet of the coal distribution device;

an ash discharge outlet leading from the chamber at a low level; and a rotatable grate above the ash discharge outlet, the rotatable grate including at least one upwardly projecting finger or disturbing formation to disturb the ash bed formed in use above and around the rotatable grate, when the rotatable grate is rotated.

Typically, the gasifier includes an ash lock in communication with the ash discharge outlet.

The closure member of the coal lock may be displaceable vertically, with its closed position being an upper position and its open position being a lower position. Thus, the upper open end of the coal distributor may be located with sufficient clearance from the coal lock closure member when it is in its lower open position so that coal can pass between the coal lock closure member and the upper end of the coal distributor.

The rotatable grate typically has a vertical dimension and a radial direction and is rotatable about a vertical axis of the ash discharge outlet, with a lower periphery of the rotatable grate being below an apex or upper end of the rotatable grate. The finger formation is typically spaced from the axis of rotation of the rotatable grate and preferably projects upwardly to approximately the same height or slightly below the apex or upper end of the rotatable grate.

The rotatable grate may have an upwardly inwardly tapering outer surface. The upwardly inwardly tapering outer surface may be staggered or stepped when seen in vertical cross-section, defining vertically and radially spaced terraces. Preferably, the finger formation is located on the lowermost outermost terrace, with a height which is at a level more-or-less equal to the uppermost innermost terrace.

The upwardly inwardly tapering outer surface of the rotatable grate may be defined by a rotatable grate component. The gasifier may thus include said rotatable grate component (which is hereinafter referred to as the only rotatable grate component) in the coal gasification chamber, with a first annular portion of an ash discharge passageway being provided between the wall of the gasification chamber and the rotatable grate component, with the grate component being rotatable about the vertical axis of the ash discharge passageway, and with the grate component being adapted so that clinker crushing is, in use, effected in the first annular portion of the ash discharge passageway as the grate component rotates;

a stationary support component at a lower end of the first annular portion of the ash discharge passageway, the stationary support component providing or defining an ash collection surface; and at least one primary scraper adapted to urge ash on the ash collection surface of the support component inwardly or outwardly along a second portion of the ash discharge passageway, as the grate component rotates, with the ash discharge passageway being adjacent a floor of the gasification chamber.

Instead, the upwardly inwardly tapering outer surface of the rotatable grate may be defined by a first rotatable grate component. The gasifier may thus include said first rotatable grate component in the coal gasification chamber, with a first annular portion of a first ash discharge passageway being provided between the wall of the gasification chamber and the first grate component, with the first grate component being rotatable about the vertical axis of the first ash discharge passageway, and with the first grate component being adapted so that clinker crushing is, in use, effected in the first annular portion of the first ash discharge passageway as the first grate component rotates;

a stationary support component at a lower end of the first annular portion of the first ash discharge passageway, the stationary support component providing or defining an ash collection surface;

at least one primary scraper adapted to urge ash on the ash collection surface of the support component inwardly or outwardly along a second portion of the first ash discharge passageway, as the first grate component rotates, with the first ash discharge passageway being adjacent a floor of the gasification chamber; and a second centrally located stationary grate component, with a second ash discharge passageway being provided between the first and second grate components and being located adjacent the floor, with the first grate component being rotatable around the second grate component, and with the first and second grate components being adapted so that the clinker crushing is, in use, effected in a first annular portion of the second gas discharge passageway as the first grate component rotates.

The gasifier may be a low temperature dry ash moving bed gasifier, similar to a Lurgi (trade name) dry ash moving bed gasifier, in which the ash discharge means is in the form of a circular (when seen in plan view) grate mounted to rotate above the ash discharge outlet, and in which the ash discharge outlet is of annular form.

The second ash discharge passageway, when present, is thus also at least partly of annular form, and at least a portion thereof is located concentrically within at least a portion of the first passageway, when seen in plan view. The portions of the first ash discharge passageway may be located at different levels, as may be portions of the second ash discharge passageway. Additionally, at least a portion of the first ash discharge passageway may be located at a different level to at least a portion of the second ash discharge passageway.

The stationary support component thus provides an upwardly directed ash collection surface, and it may protrude radially inwardly from the wall. Said at least one outer or primary plough or scraper thus protrudes from the only or first discharge or grate component and is adapted to direct ash inwardly along the collection surface as the only or first discharge or grate component rotates.

The second passageway, when present, may comprise a more-or-less annular first portion, a second portion extending radially outwardly from the lower end of the first portion, and a third annular portion in communication with the second portion. The second stationary central discharge or grate component, when present, may comprise a central pillar and at least one stationary inner or secondary plough protruding outwardly from the pillar into the second portion of the passageway. When the second grate component is not present, the gasifier may still include a central pillar, although typically a shorter one.

The first rotatable grate component and the second stationary central grate component thus together constitute a grate.

A plurality of the primary or outer ploughs, staggered or spaced apart about the rotational axis of the only or first grate component, may be provided. Similarly, a plurality of the stationary secondary or inner ploughs, staggered or spaced apart about the pillar, when present as part of the second grate component, may be provided.

The central pillar may include a gasification agent passageway, extending along its length, with the lower end of the passageway being open at the lower end of the pillar and being connected, by means of a conduit, to a supply of the gasification agent. The gasification agent passageway has one or more gasification agent outlets. When the gasifier includes said second grate component, the central pillar may include at least one gasification agent outlet at or in proximity to the upper end of the pillar protruding into the gasification chamber, with this outlet being in communication with the first portion of the second passageway; and at least one further gasification agent outlet in the pillar between its ends, the further outlet being in communication with the first passageway. Preferably, however, there is no gasification outlet at or in proximity to the upper end of the pillar.

The first or only grate component may comprise a hollow support structure rotatable about the pillar, with the further gasification agent outlet, or a gasification agent outlet, in the pillar being in communication with the hollow interior of the first or only grate component; an outer shield covering at least a portion of the support structure; and at least one gasification outlet in or adjacent the outer shield, for discharging gasification agent from the inside of the support structure into the gasification chamber as the first or only grate component rotates about the pillar. The outer surface of the outer shield of the first or only grate component may taper upwardly inwardly from the outer ploughs. The angle which the outer surface forms with the horizontal may be greater than the angle of repose of coal ash.

In particular, the outer surface of the first or only grate component may be staggered or stepped when seen in vertical cross-section, with each step or layer comprising a plurality of outer shield plates arranged circumferentially in abutting or overlapping relationship and sloping upwardly inwardly. The different layers of shield plates thus together constitute the outer shield. A circumferential gasification agent opening or outlet may then be provided at each step or layer such that gasification agent passes underneath the lower edges of the outer shield plates of each step or layer.

The rotatable grate may include four circumferential gasification agent outlets which are vertically and radially spaced, ranging from a highest, radially innermost to a lowest, radially outermost gasification agent outlet and including a second highest and a third highest outlet.

The gasification agent outlets may be dimensioned to release gasification agent at a common supply pressure in the following proportions:

Lowermost, radially outermost: 30% to 50%

Third highest: 20% to 40%

Second highest: 10% to 30%

Highest, radially innermost: 5% to 15%

Breaker ribs may be provided on portions of the pillar and the first grate component which define between them the first annular portion of the second discharge passageway with the clinker crushing in the first annular portion of the second ash discharge passageway being effected between the breaker ribs.

The coal discharge opening of the coal lock may be circular, and the coal lock closure member may thus be circular in plan view. Thus, the closure may typically be of disc-like form.

The hollow coal distributor may have a substantially frusto-conical form and may be open ended so that it has a smaller circular opening and a larger circular opening. Its smaller opening will thus constitute its upper end, while its larger opening will constitute its lower end. The openings of the coal distributor may be aligned with the coal discharge opening of the coal lock. The cone angle of the coal distributor will be such as to inhibit bridging and to facilitate mass flow of coal over the coal distributor. Thus, typically, the angle of inclination of at least a major portion of the coal distributor is about 60° to the horizontal.

In one embodiment of the invention, the diameter of the smaller opening of the coal distributor may be greater than that of the coal lock coal discharge opening. The upper end of the skirt may then be located in proximity to the smaller opening of the coal distributor. The ratio of the diameter of the smaller opening to that of the larger opening of the coal distributor is then typically about 1:2.

However, in another embodiment of the invention, the diameter of the smaller opening of the coal distributor may be about the same as that of the coal lock coal discharge opening. The upper end of the skirt may then be located about midway between the upper and lower ends of the coal distributor. The ratio of the diameter of the smaller opening to that of the larger opening of the coal distributor may then typically be about 1:6.

The skirt may be of substantially cylindrical form. A lower end portion of the skirt may protrude from the lower end of the coal distributor so that the lower end of the skirt is located at a lower level than the lower end of the coal distributor.

The gasifier may include a second skirt around the other or first skirt and spaced therefrom. The upper end of the second skirt may depend from the inside of the coal distributor, and its lower end may be located at a lower level than the lower end of the coal distributor. The second skirt may taper downwardly inwardly so that it is of inverted open ended hollow frusto-conical form.

The gasifier may include a plurality of inwardly directed circumferentially spaced coal distribution ribs on the cylindrical wall at about the level of the lower end of the coal distributor, with the ribs adapted to distribute coal away from the inner surface of the wall. Each rib may include an upper coal deflection surface which slopes downwardly away from the wall and which, in use, serves to distribute coal downwardly away from the inner surface of the wall.

The heights of the coal distributor and the skirts are such that their lower ends will, in use, be located below the normal coal bed level in the gasification chamber.

The coal distribution device may be attached to the cylindrical wall. The wall may comprise outer and inner skins spaced apart so that a cavity is provided between them, with the cavity normally containing water so that the inner skin and the water-filled cavity constitute a water jacket along the inside of the outer skin.

According to a second aspect of the invention, there is provided a method of operating a fixed bed coal gasifier in accordance with the first aspect of the invention, the method including feeding coal into the coal gasification chamber through the coal lock and distributing the coal inside the coal gasification chamber by means of said coal distribution device to form a fixed coal bed;

feeding a gasification agent into the gasification chamber;

gasifying the coal in the gasification chamber to produce synthesis gas as well as ash in an ash bed below the coal bed; and rotating said rotatable grate to remove ash through the ash discharge outlet and to disturb the ash bed with said at least one finger or disturbing formation.

The rotatable grate may include a first grate component, or an only grate component, as hereinbefore described, and in particular a first grate component, or an only grate component, which has an outer surface which is staggered or stepped in vertical cross-section, with a circumferential gasification agent outlet being provided at least some steps or layers, typically at each step or layer, the gasification agent outlets thus being vertically and radially spaced. The method may include feeding the gasification agent into the gasification chamber through the circumferential gasification agent outlets, preferably at each step or layer, including a bottom radially outermost gasification agent outlet on the bottom radially outermost step or layer. The gasification agent may be fed in proportion to the radial position of a gasification agent outlet. Thus, the radially outermost gasification agent outlet may feed the most gasification agent and a radially innermost gasification agent outlet may feed the least of the gasification agent.

Typically, no gasification agent is fed through said upper end of the central pillar.

The rotatable grate may include four circumferential gasification agent outlets which are vertically and radially spaced, ranging from a highest, radially innermost to said lowest, radially outermost gasification agent outlet and including a second highest and a third highest outlet. The gasification agent may be fed through the outlets in the following proportions:

Lowermost, radially outermost: 30% to 50%

Third highest: 20% to 40%

Second highest: 10% to 30%

Highest, radially innermost: 5% to 15%

Preferably, the gasification agent is fed through the outlets in the following proportions:

Lowermost, radially outermost: 35% to 45%

Third highest: 25% to 35%

Second highest: 15% to 25%

Highest, radially innermost: 5% to 15%

The invention will now be described by way of example with reference to the accompanying diagrammatic drawings.

Figure 1:
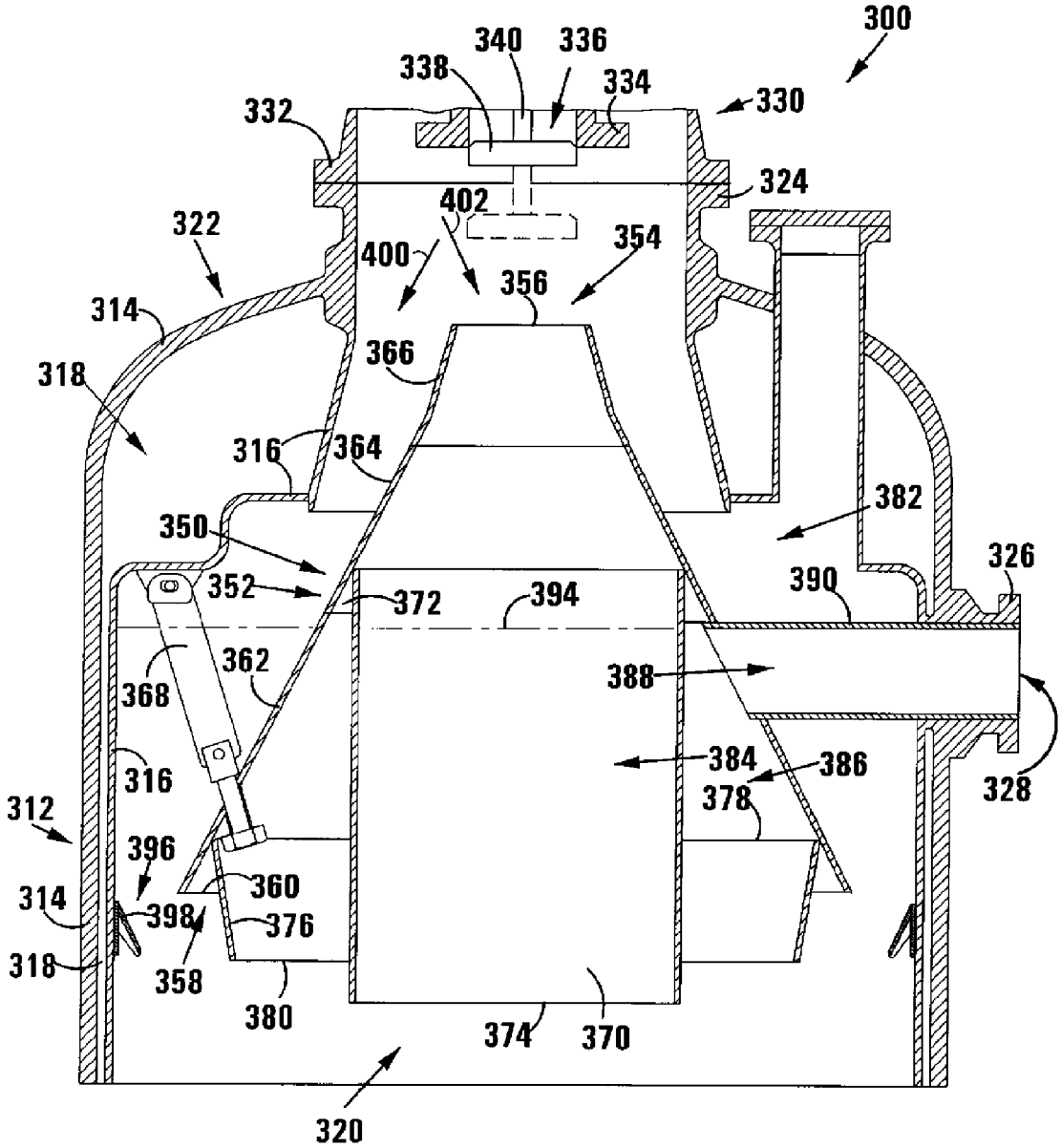
FIG. 1 shows, in part, a longitudinal or vertical section view of a fixed bed coal gasifier according to one embodiment of the invention.

Referring to FIGS. 1 to 4, reference numeral 300 generally indicates a fixed bed Lurgi (trademark) coal gasifier according to one embodiment of the invention.

The gasifier 300 includes an upright circular cylindrical wall, generally indicated by reference numeral 312. The wall 312 comprises an outer skin 314, and an inner skin 316 spaced from the outer skin 314 so that a cavity 318 is defined between the skins 314, 316. The cavity 318 normally contains water. In other words, the skin 316 and the water filled cavity 318 constitute a water jacket along the inside of the outer skin 314. The wall 312 defines a coal gasification chamber, generally indicated by reference numeral 320.

The wall 312 is closed off, at its upper end, by means of an ellipsoidal head, generally indicated by reference numeral 322. The head 322 is also of double skin construction, and thus also has an outer skin 314, an inner skin 316 and a water cavity 318 which is thus an extension of the cavity 318 of the wall 312. A flanged circular connection 324, defining a circular opening, is provided at the centre of the head 322.

A flanged connection 326, providing a gas outlet passageway 328, is provided in the wall 312 at a high level, i.e. near the upper end of the gasifier 300.

The gasifier 300 also includes a coal lock, generally indicated by reference numeral 330, located above the head 322. The coal lock 330 is shown in part only and includes a lower flanged connection 332 which is connected to the flanged connection 324.

The coal lock 330 includes a component 334 which defines a centrally located coal discharge opening 336 which is in communication with the gasification chamber 320. A circular disc-like closure member 338 closes off the discharge opening 336. An actuating rod 340 protrudes upwardly from the closure member 338. By means of the rod 340, the closure member 338 is displaceable from an upper closed position (as shown in full line in FIG. 1) in which it closes off the coal discharge opening 336, to a lower open position (as shown in broken line in FIG. 1) in which the coal discharge opening 336 is uncovered so that coal can pass under gravity from the coal lock 330 through the opening 336 into the coal gasification chamber 320.

The gasifier 300 also includes a fixed or static coal distribution device, generally indicated by reference numeral 350, inside the coal gasification chamber 320. The coal distribution device 350 includes a hollow substantially frusto-conical open ended coal distributor, generally indicated by reference numeral 352. The coal distributor 352 thus has a smaller opening, generally indicated by reference numeral 354, which is upwardly directed, i.e. is at the upper end 356 of the coal distributor 352. It also has a larger opening, generally indicated by reference numeral 358. The larger opening 358 is thus provided at the lower end 360 of the coal distributor.

The coal distributor 352 is made up of a lower hollow open-ended frusto-conical or truncated-conical section 362 which is attached to the skin 316 of the wall 312 by means of circumferentially spaced threaded connectors 368. It also includes an intermediate hollow open-ended frusto-conical section 364 attached to an upper end portion of the section 362, as well as an upper hollow open-ended frusto-conical section 366, attached to an upper end portion of the section 364. The upper end of the section 366 thus provides the upper end 356 of the coal distributor 352, while the lower end of the lower section 362 provides the lower end 360 of the coal distributor 352.

The coal distribution device 350 also includes a circular cylindrical skirt 370 around the inside of the coal distributor 352. An upper end portion of the skirt 370 is connected to the coal distributor 352, by means of flanged connections 372, roughly midway between the upper end 356 and the lower end 360 of the coal distributor 352. The lower end 374 of the skirt 370 protrudes beyond the lower end 360 of the coal distributor 352.

The coal distribution device 350 also includes a second skirt 376 around the skirt 370 and spaced therefrom. The upper end 378 of the skirt 376 is mounted to the inside of the coal distributor 352, in proximity to its lower end 360. The lower end 380 of the skirt 376 is located at a lower level than the lower end 360 of the coal distributor 352. The skirt 376 tapers downwardly inwardly so that it is of inverted open-ended hollow frusto-conical form.

An annular outer coal passageway, generally indicated by reference numeral 382, is provided between the coal distributor 352 and the inner skin 316 of the wall 312. A central coal passageway, generally indicated by reference numeral 384, is provided by the inside of the skirt 370. An annular gas collection zone, generally indicated by reference numeral 386, is defined between the skirts 370, 376. The top of the collection zone 386 is thus closed off by the section 362 of the coal distributor 352; however, the bottom thereof is in communication with the coal gasification chamber 320. A gas outlet, generally indicated by reference numeral 388, is provided in the coal distributor 352. A conduit 390 connects the gas outlet 388 to the gas outlet passageway 328 of the connection 326 in the wall 312.

The dimensions of the coal distribution device 350, e.g. the height of the coal distributor 352 and the heights of the skirts 370, 376, are such that the lower ends of the coal distributor and the skirts are normally located within a coal bed 392 in the gasification chamber 320. The minimum coal bed level is indicated by broken line 394.

The sections 362, 364 of the coal distributor 350 taper upwardly inwardly at an angle of about 60° to the horizontal. The diameter of the upper opening 354 of the coal distributor 352 is typically about 0.5 metres, while that of its lower opening 358 is typically about 3.4 metres.

A plurality of inwardly directed circumferentially spaced coal distribution ribs, each generally indicated by reference numeral 396, are provided on the skin 316 of the wall 312, at the level of the lower end 360 of the coal distributor 352. Each distribution rib 396 has an upper coal deflection surface 398 which slopes downwardly away from the wall 312.

Figure 2:
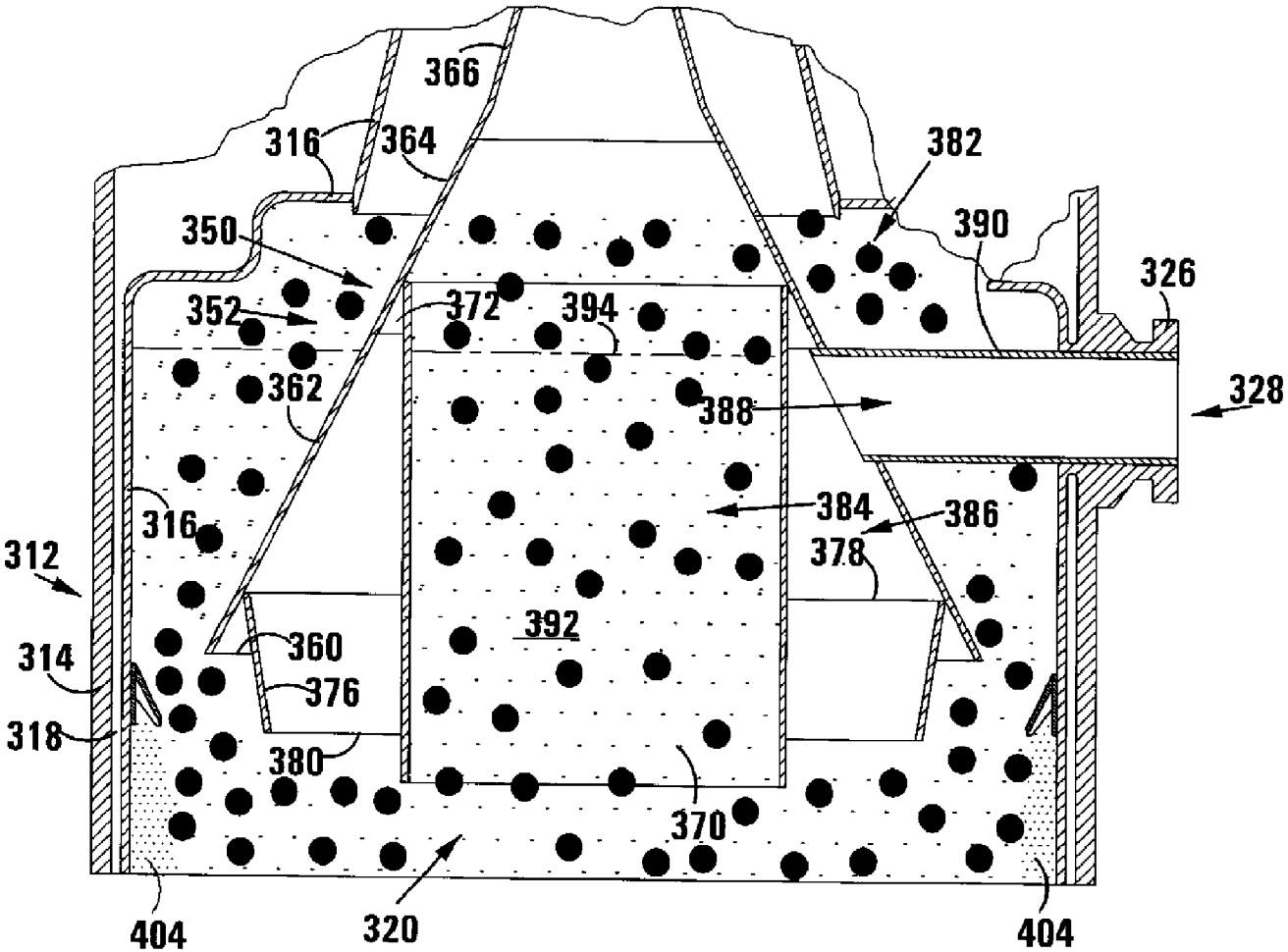
FIG. 2 shows a longitudinal or vertical section view similar to FIG. 1, with the gasification chamber of the gasifier containing a fixed bed of coal.

In use, the gasification chamber 320 will thus contain the fixed bed 392 of coal, as indicated in FIG. 2. The coal will burn in a fire bed (not shown) located at the bottom of the coal bed, with ash collecting in an ash bed (not shown) below the fire bed. The burning of the coal is effected by means of a gasification agent, i.e. a mixture of oxygen and steam, which enters the bottom of the gasification chamber through outlet or discharge openings in a rotating grate (described in more detail hereinafter) located below the fire bed, and above the ash discharge outlet. On its passage through the coal bed, the gasifying agent thus reacts with the coal to form raw gas which passes upwardly through the coal bed, collects in the gas collection zone 386 and exits the gasifier through the gas outlet 388, the conduit 390 and the gas passageway 328.

To charge coal into the gasification chamber 320, the discharge opening 336 of the coal lock 330 is opened by moving the closure member 338 from its closed position to its open position, when the coal bed level, i.e. the top of the coal bed in the chamber 320, is approximately at the level of the line 394. It will be appreciated that the lower ends of the coal distributor 352 and the skirts 370, 376 will then still be located within the coal bed.

The coal that is discharged from the coal lock 330 will initially free fall into the outer coal passageway 382, as indicated by arrow 400 in FIG. 1, until the top of the coal bed is more-or-less at the same level as the upper end 356 of the coal distributor 352. Thereafter, the coal will pass into the central coal passageway 384, as indicated by arrow 402. Coal passes evenly from the passageways 382 and 384 into the coal bed, i.e. the coal levels in the passageways 382, 384 remain more-or-less the same as the coal passes therethrough into the coal bed.

Figure 5:
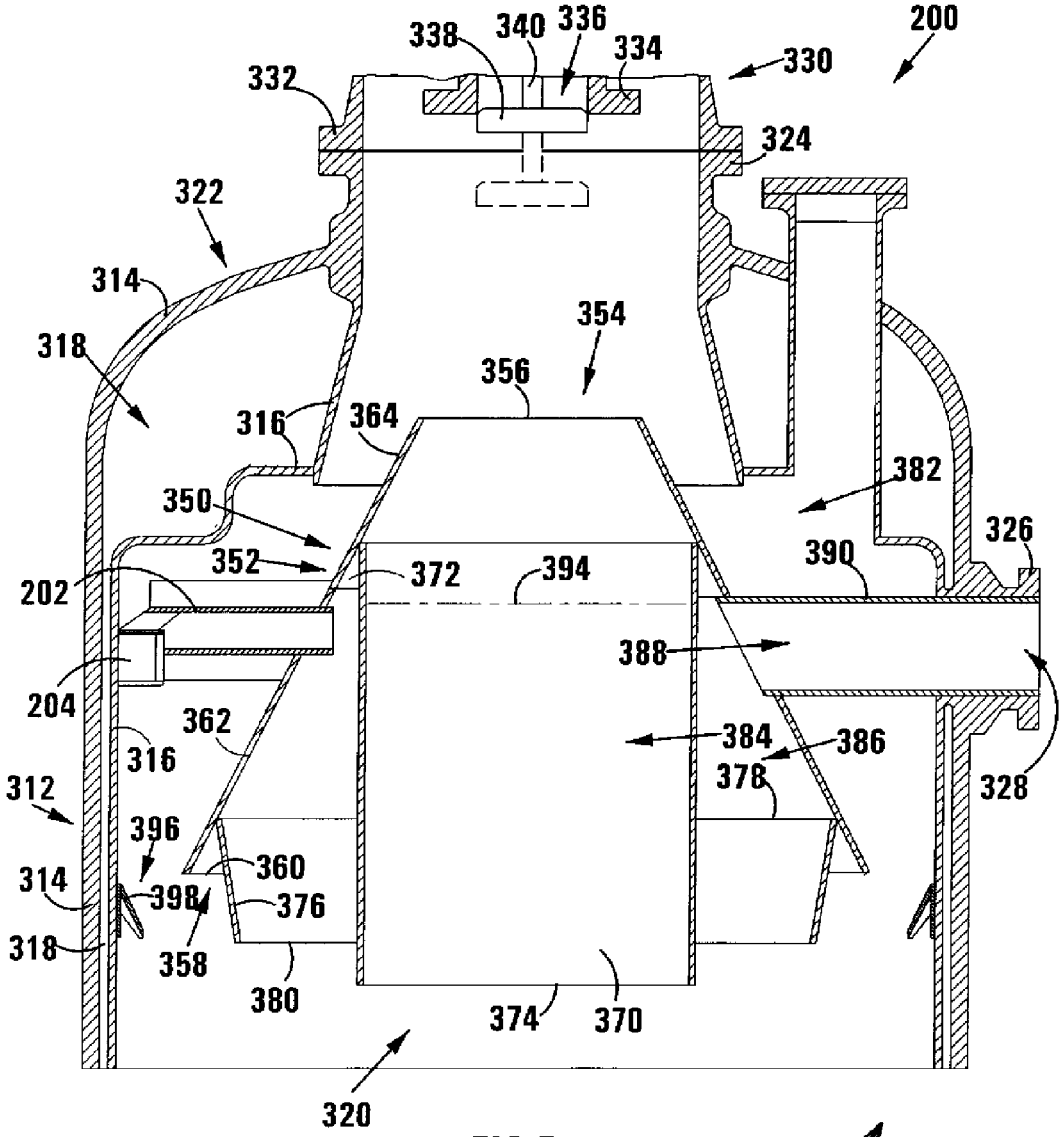
FIG. 5 shows a longitudinal or vertical sectional view of a fixed bed coal gasifier according to another embodiment of the invention.
Figure 6:
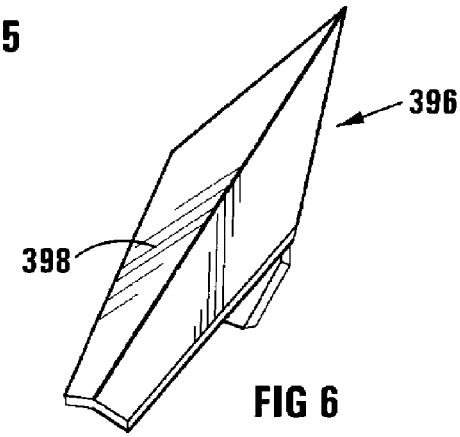
FIG. 6 shows a three-dimensional view of one of the coal distribution ribs shown in FIG. 5.

Referring to FIGS. 5 and 6, reference numeral 200 generally indicates a fixed bed Lurgi (trademark) coal gasifier according to another embodiment of the invention.

Parts of the gasifier 200 which are the same or similar to those of the gasifier 300, are indicated with the same reference numeral.

In the gasifier 200, the coal distributor 352 is mounted to the skin 316 of the wall 312 by means of a horizontally extending cylindrical mounting component or support pipe 202, instead of the connectors 368. The components 202 thus extend from circumferentially spaced apertures in the section 362 to a bracket 204 attached to the skin 316 of the wall 312.

In the gasifier 200, the upper section 366 of the coal distributor 352 has been dispensed with. The upper end 356 of the coal distributor 352 is thus the upper end of the section 364.

The coal distribution ribs 396 of the gasifier 200 are slightly different in appearance and construction to those of the gasifier 300; however, they perform the same function.

The Applicant is aware of known fixed bed Lurgi gasifiers that have a cylindrical or inwardly tapering, i.e. hollow open-ended inverted frusto-conical, skirt depending from the roof or head of the gasifier so that coal that is discharged from the coal lock passes along the inside of the skirt to be distributed into the coal bed, with the lower end of the skirt normally being located inside the coal bed. An annular gas collection zone is provided between the skirt and the wall of the gasification chamber, with raw gas which collects in the zone being withdrawn therefrom through a gas outlet. Such a skirt is also known as a "Bosman" skirt.

However, in these known gasifiers, segregation of the coal that enters the coal gasification chamber from the coal lock, into coarser and finer fractions, is experienced. This problem is brought about when the coal is discharged into the gasification chamber from the coal lock during the normal loading cycle of the gasifier.

The segregation of the coal into the coarser and finer fractions is as a result of the following segregation mechanisms:

(a) when coal flows from a zone of smaller cross-sectional area to one of larger cross-sectional area in an enclosed passage, some segregation thereof into coarser and finer fractions occurs due to fines filtering through the body of coal as it flows; and (b) when coal flows from a zone of smaller cross-sectional area to one of larger cross-sectional area in an open space, i.e. not confined by an enclosed passage, segregation thereof into coarser and finer fractions occurs due to larger or top size particles 'rolling' to the outside.

Mechanism (b), i.e. free-fall of the coal, is experienced in the first half of a coal load cycle of the gasifier, i.e. immediately after the coal lock has been opened, and is normally associated with well homogenized coal particle size distribution due to 'turbulence' of flow. The second half of the coal load cycle is associated with 'slow' downward movement of coal from the coal lock, and mechanism (a) then prevails.

Figure 3:
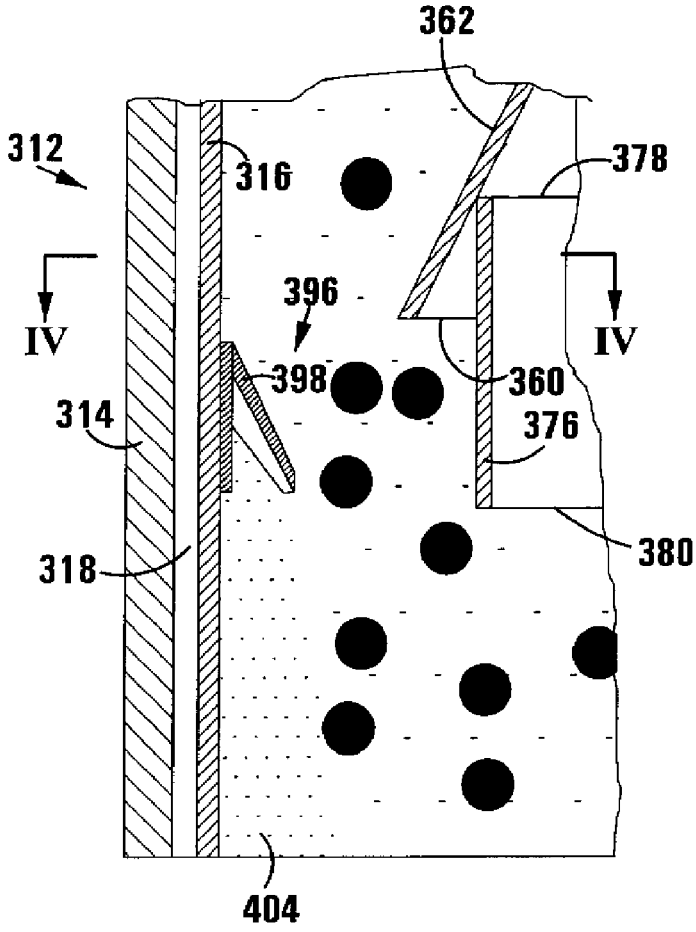
FIG. 3 shows an enlarged view of part of a gasifier similar to the gasifier shown in FIG. 2 but which has a vertically extending skirt.
Figure 4:
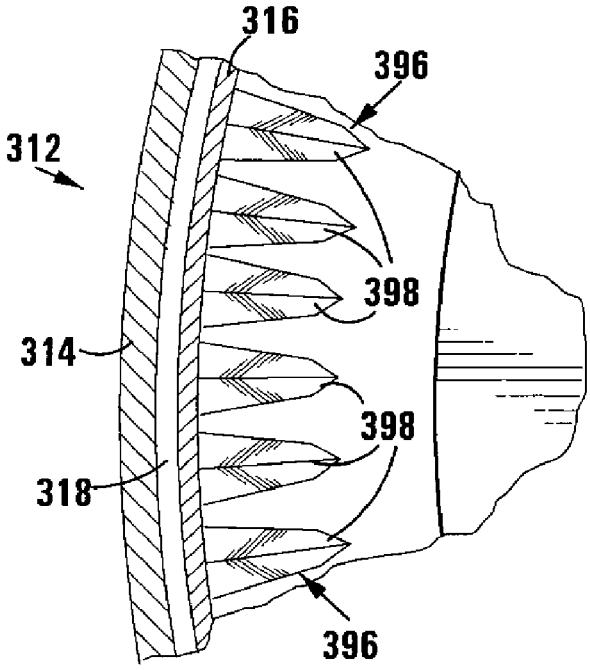
FIG. 4 shows a sectional view through IV-IV in FIGS. 2 and 3.

The Applicant has found that with the Bosman skirt a coarse particle-rich coal fraction accumulates against the wall of the gasification chamber, i.e. in a near outer diameter (near jacket) zone 404 as indicated in FIGS. 2 and 3, with a fine particle-rich coal fraction accumulating in an annular zone immediately adjacent the near outer diameter zone 404. Inside the annular zone, there is then a central zone containing a more-or-less normal coal particle distribution of coarse coal particles (56-100 mm), medium coal particles (28-56 mm) and fine coal particles (5-28 mm). Typically, the near outer diameter zone is about 0.25 meters thick. It is believed that the coarse particle-rich coal fraction in the near outer diameter zone results at least in part from segregation of coal particles due to the 'rolling' action of the largest coal particles to the outer diameter of the coal gasification zone, i.e. due to mechanism (b).

Additionally, it has been found that fine coal particles accumulate against an inner surface of the Bosman skirt, due to "filtering" thereof through larger coal particles, as the coal bed moves downwardly, i.e. due to mechanism (a). These fine coal particles are in contact with raw gas at the lowermost edge of the skirt, where the raw gas has an increased velocity due to the reduced cross-sectional diameter of the gas collection zone as compared to the cross-sectional diameter of the gasification chamber. Thus, fine gas particles which are picked up by the raw gas stream, do not have much chance of disengaging from the raw gas, and are thus carried over with the raw gas that is withdrawn from the gasifier.

This segregated particle size distribution ('PSD') results in preferential gas flow paths, as evidenced by major gasifier instabilities and "hot spots" due to this channelling phenomenon. In other words, the gasifying agent and the raw gas tend to follow upwardly extending paths or channels of least resistance through the coal bed. Furthermore, the gas passes preferentially through coarser coal particles which provides a path of least resistance through the coal bed so that channelling occurs in the near jacket zone, with resultant high local heat flux zones occurring there. The Applicant has found that this leads to overheating of, and subsequent damage to, the jacket wall; poor gasifier operation such as extreme fire bed fluctuations, frequent load cutbacks due to temperature instabilities at high gasifier loads, and high gasifier sensitivity to excess fines in the coal; damaged grate ploughs due to overheating; etc.

The Applicant has found that, by means of the coal distribution device 350 and coal distribution ribs 396 of the present invention, a much more uniform PSD of coal particles is obtained in the top of the coal bed. In particular, the coal distribution device 350 simultaneously distributes coal from the annular passageway or zone 382 as well as from the central passageway or zone 384 into the coal bed, as indicated in FIG. 1. The coal distribution device 350 also allows upwardly moving counterflowing raw gas to exit the cross-section of the gasification zone 320 through the annular zone 386 and from there through the single gas outlet 388. The gas is thus extracted in an annular zone which is spaced from the wall 312.

It has been found that, with the coal distribution device 350, a more uniform PSD can be obtained in the coal bed below the coal distribution device 350.

Furthermore, the amount of fines that is in contact with the raw gas at the point where the raw gas exits the coal bed is reduced, as compared to the Bosman skirt configuration, resulting in less carry-over of fine coal particles with the raw gas stream. This is due to the fact that there is no accumulation of fine coal particles in a layer or zone at or near the point at which the raw gas separates from the coal bed.

Still further, the coal distribution ribs 396 function in the manner of forcing coarser coal particles into the area below the overhang provided by the lower edge portion of the coal distributor 352, while fine coal particles pass between adjacent ribs into the near jacket zone, as indicated by reference numeral 404 in FIGS. 2 and 3. There is thus a concentration of fine particles in the near jacket zone 404. Fine coal particles provide an increased resistance to gas flow so that substantially reduced channelling takes place in the near jacket zone, resulting in a substantial reduction in hot spot formation against the inner skin (jacket) 316. The fine coal particles also act as an insulation layer against the inner skin 316. Due to the shape and positioning of the ribs 396, they do not impede or block passage of coal particles along the passageway or zone 382.

Typically, the ribs are mounted to the inner skin 316 with a 130 mm pitch. Thus, with a 4 metre inner diameter gasification chamber 320, a total of 93 such ribs will be provided. The gaps between adjacent ribs, at the inner skin 316, will thus be sufficiently small to permit passage of fine coal particles (5-28 mm), while not permitting the passage of coarse particles (58-100 mm).

The coal gasifier according to the invention is further characterized thereby that it does not have a so-called Bosman skirt nor does it have any static coal distribution device between the upper end 356 of the coal distributor 352 and the coal lock closure member 338.

By virtue of comparative test runs conducted on known Lurgi gasifiers and a Lurgi gasifier in accordance with the invention, the following advantages of the gasifier in accordance with the invention, particularly when compared to the known Lurgi gasifiers, were identified:

reduced channelling and hot spots against the water jacket a more stable flat and uniformly thick fire bed a reduced number of preferential flow paths due to low pressure drop zones in the coal bed reduction of heat flux through the water jacker, as evidenced by reduced boiler feed water consumption in the water jacket, i.e. reduced jacket steam production a reduction in the numbers of load cutbacks due to process instability more stable grate operation, and good control of the grate operation more stable coal lock temperatures, typically within the range of 140° C. to 180° C.

decreased carry-over of fine coal particles with the raw gas more stable and controllable (within narrow bands) gas outlet temperatures (typically 480° C. to 530° C.) and ash temperatures (typically 290° C. to 330° C.)

sustainable and, possibly, increased maximum gasifier loads with minimum negative impact on equipment enhanced process stability and effective reactions over the reaction zone Additionally, the coal distribution device 350 and/or the ribs 396 can provide one or more of the following benefits:

ability to handle the coal loads and complex thermal expansion requirements of the gasifier a degree of height adjustment within the coal gasification chamber effective cooling of the device since coal is in contact with all metal surfaces of the coal distribution device 350 an effective gas seal and minimum thermal impact due to the manner in which the gas outlet 388 is connected to the gas outlet passageway 328, as indicated in FIG. 5 removability of the section 366 permits ready access into the gasifier and removal of gasifier grate components the angles of inclination of the sections of the coal distributor 352 ensure good coal mass flow along the coal passageway little or no blockage or bridging of coal particles occurs in the coal passageways 382, 384 or in the coal bed coal segregation from the coal discharge opening 336 of the coal lock 330 to the lower end of the coal distribution device 350 is reduced or minimized.

Although the coal distribution device 350 and the ribs 396 have proved to provide a much more uniform coal particle size distribution over the gasifier radial cross section than the Bosman skirt, it was found that there is still an unacceptably wide range of instability present in the gasifier operation, including thermal extremes in an upper region of the gasifier. A series of experiments on a scaled model indicated that an unexpected annular region of coarser material formed when the coal distribution device 350 is used. This problem has been successfully addressed by the present invention, by means of a modification to the rotatable grate to provide an upwardly projecting finger or disturbing formation to disturb the ash bed in the gasifier. The rotatable grate used in conjunction with the coal distribution device 350 is described in more detail hereunder.

Figure 7:
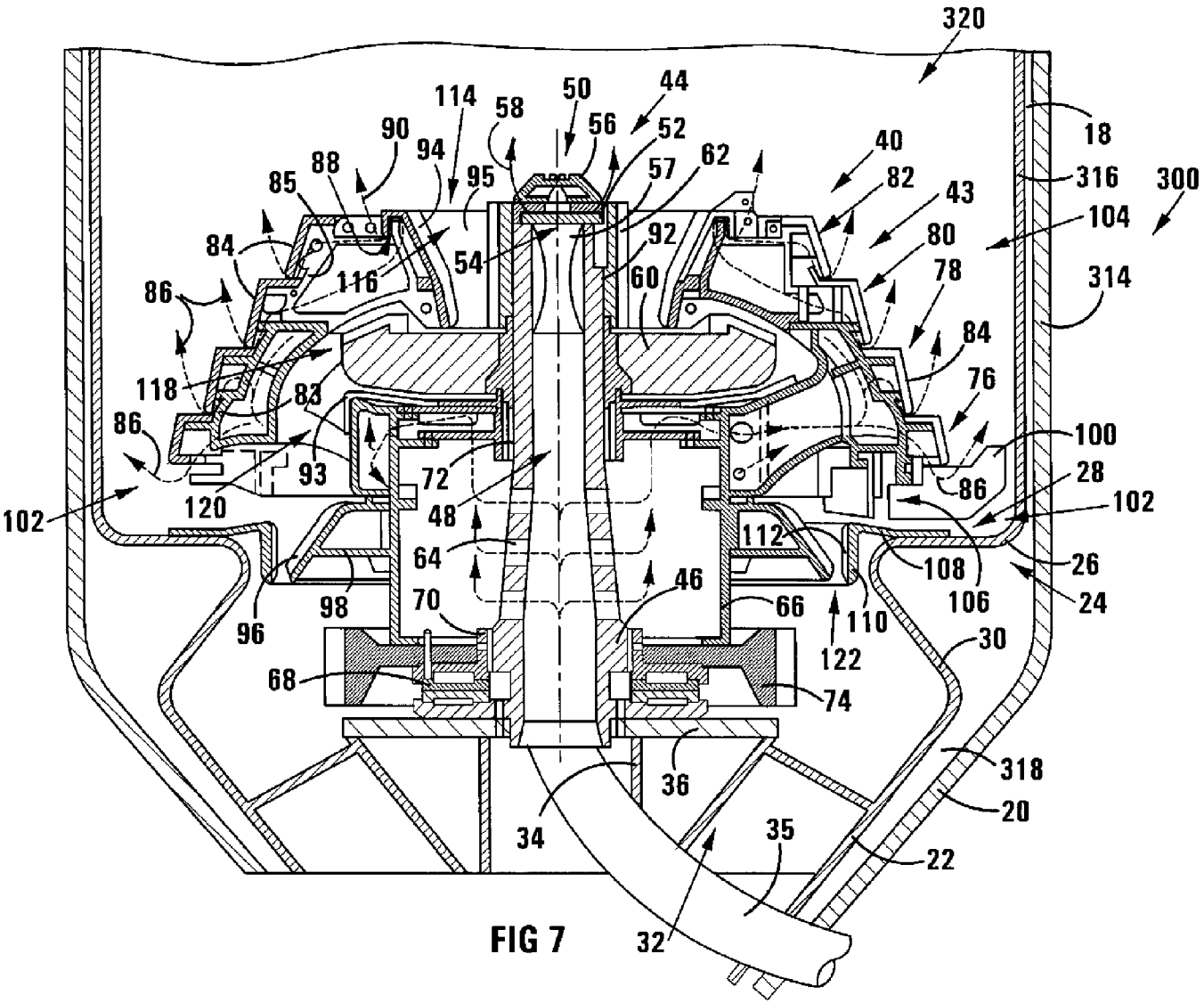
FIG. 7 shows a vertical sectional view of part of the fixed bed coal gasifier of FIG. 1 or FIG. 5, which includes a grate.

Referring to FIG. 7, the gasifier 300 also includes an inwardly tapering outer floor 20 which is attached to the lower end of the skin 314, as well as an inner floor 22 which is attached to the skin 316. The space 318 is thus maintained between the floors 20, 22. In the zone where the floor 22 is attached to the wall 316, a support component, generally indicated by reference numeral 24, is provided. The support component 24 has a horizontally located circumferentially extending radially inwardly protruding portion 26, providing an upper horizontal ash collection surface 28, as well as a portion 30, also extending circumferentially, located between the inner periphery of the portion 26 and the upper end of the floor 22.

An inner stationary support structure, generally indicated by reference numeral 32, protrudes inwardly from the floor 22 and has a cylindrical component 34 through which extends a gasification agent feed line or conduit 35 which leads from a supply of the gasification agent. The gasification agent is thus typically a mixture of oxygen and steam. A support plate 36 is mounted on the support structure 32 and the component 34.

As mentioned hereinbefore, the gasifier 300 also includes a grate, generally indicated by reference numeral 40, located inside the skin 316, at the lower end of the gasification chamber 320 defined by the skin 316.

The grate 40 comprises a first outer rotatable grate component, generally indicated by reference numeral 43, as well as a second stationary inner grate component, generally indicated by reference numeral 44.

The stationary grate component 44 comprises an upright pillar 46 mounted to the support plate 36. The pillar 46 has a central gasification agent passageway 48 which has an inlet at the lower end of the pillar, with the inlet being in communication with the gasification feed line 35; however, the upper end of the passageway 48 is closed off with a venturi structure 50 to prevent ash intrusion into the passageway 48. The structure 50 comprises end plates 52 closing off the upper end of the passageway 48 against ash intrusion, and may be provided with a gasification agent outlet 54 for discharging gasification agent from the passageway 48 into a zone below a protective cap 56, with gasification agent then passing outwardly into the gasification chamber 320 along the lower peripheral edge of the cap 56, as indicated by arrows 58. Preferably, however, the outlet 54 is blocked. A venturi 57 is located below the end plates 52, for creating a flow induced low pressure and serving to extract gasification agent leaking between the stationary inner grate component 44 and the outer rotatable grate component 43, when the outlet 54 is not blocked.

A number of circumferentially staggered stationary inner ploughs 60 protrude outwardly from the pillar 46. Breaker ribs 62 are provided around the upper portion of the pillar 46, i.e. the portion thereof between the ploughs 60 and the end cap structure 50.

A plurality of vertically and circumferentially spaced gasification agent passageways 64 are provided in the pillar 46 below the ploughs 60.

The outer rotatable grate component 43 comprises a hollow rotatable support structure 66 rotatably mounted to the pillar 46 by means of thrust bearings 68 and journal bearings 70 and 72. The support structure 66 includes a ring gear 74 which engages a pinion gear (not shown) mounted to an output shaft of a gearbox (not shown) driven by a variable speed electric motor (not shown) for driving the grate component 43 to rotate, typically at between 2 and 12 rph. Two sets of the pinion gears, gearboxes and motors are provided.

The interior of the support structure 66 is in communication with the passageways 64 in the pillar 46. The outer surface of the grate component 43 is of conical form, being stepped or staggered, so as to provide four 'layers' or terraces, generally indicated by reference numerals 76, 78, 80 and 82 respectively, with the layer or portion 76 having the largest diameter and the layer or portion 82 having the smallest diameter. Each step or layer 76 to 82 comprises a plurality of circumferentially arranged outer shield plates 84 located in abutting or overlapping relationship. The shield plates 84 in each layer or step slope upwardly inwardly. The angle of the outer surface of the grate component 43, as defined by the shield plates 84, is in the region of 55° to the horizontal, i.e. greater than the angle of repose of ash which is about 35° to the horizontal. By 'angle of repose' is meant the angle of maximum incline at which a heaped mass of loose coal ash will be stable with no particles sliding down this incline.

The shield plates 84 in the layers or portions 76 and 78 are mounted to a lower support ring 83 forming part of the grate component 43, while the shield plates in the layers or portions 80 and 82 are mounted to an upper support ring 85 also forming part of the grate component 43. Each support ring typically comprises three segments which are attached together.

Circumferentially extending gasification agent outlets are provided in the grate component 43 such that the gasification agent can flow underneath the lower edges of the outer shield plates 84 at each level or step, as indicated by arrows 86. The configuration of the shield plates thus ensures the gasification agent flow and also prevents ash intrusion into the grate component 43. An additional circumferential gasification agent outlet 88 may also be provided at the upper end of the grate component 43 so that gasification agent can also be distributed therethrough as indicated by arrow 90. Typically, however, this is not preferred.

Additionally, a negligible amount of gasification agent can pass between the rotating support structure 66 and the stationary pillar 46, via a join line 92, also to be discharged through the venturi 57 and the structure 50.

The support structure 66 includes an annular floor plate 93 immediately below the lower edges of the ploughs 60 so that ploughs act as scrapers as the plate rotates below them, in use.

An inner breaker ring 95, having ribs 94, is provided around an upper portion of the support ring 85, while an outer breaker ring 98, having ribs 96, is provided on the support structure 66.

Three circumferentially spaced outer ploughs 100 are attached to the outer grate component 43 and are arranged such that they pass with limited clearance over the ash collection surface 28 of the component 26.

A first ash discharge passageway 102 is defined between the skin 316, support component 24 and the grate component 43. The first ash discharge passageway 102 comprises a first annular portion 104 defined between the shield plates 84 of the grate component 43 and the skin 316, as well as a second portion 106 protruding radially inwardly from the lower end of the portion 104, along the surface 28 and along a wear plate 108.

The wear plate 108 protrudes inwardly from the component 26, and is provided with a collar portion 110, which is also fitted with breaker ribs 112.

The breaker ribs 62 and breaker ring 94 define between them a first cylindrical portion 116 of a second ash discharge passageway 114. The passageway 114 also has a second portion, generally indicated by reference numeral 118, protruding radially outwardly from the lower end of the portion 116, as well as a third annular portion, generally indicated by reference numeral 120, which is in communication with the portion 118.

The breaker rings 96, 112 define between them an annular ash discharge passageway, generally indicated by reference numeral 122, into which ash is discharged from the portion 106 of the passageway 102. The portion 120 of the passageway 114 also discharges ash into the ash discharge passageway 122.

It will be appreciated that ash discharged through the passageways 102, 114 and 122, which are thus in proximity to or adjacent the floors 22, falls into a floor zone of the gasifier 300 and is discharged through an ash outlet (not shown) provided at the lower end of the gasifier.

The grate 40 includes an upwardly projecting finger or disturbing formation 500 (only shown in FIG. 8 of the drawings) mounted on the radially outermost, lowest layer or step or terrace 76. The finger 500 has a height which is slightly less than the height of the pillar 46.

In use, the gasifier 300 is operated by feeding coal batchwise into the top thereof through the coal lock 330 while injecting gasifying agent as hereinbefore described continuously into the bottom of the reaction zone through the gasification agent outlets as hereinbefore described, thereby to gasify coal located in a slow moving bed within the gasification chamber 320. Ash is continuously withdrawn from the bottom of the gasification zone by the rotation of the gasifier component 43 which leads to the ploughs 100 continually rotating and discharging ash through the passageway 102. Simultaneously, ash is discharged through the passageway 114.

Typically, about 20% of the ash is removed through the passageway 114, and about 80% through the passageway 102. As the grate component 43 rotates, clinker crushing is performed between the breaker ribs 62, 94, between the shield plates 84 and the skin 316, and between the breaker ribs 96 and 112, as hereinafter described in greater detail. The shield plates 84 also protect the grate 40 against wear and high ash temperatures.

By 'clinker' is meant a solid agglomerate of melted ash which needs to be crushed to enable it to be extracted from the gasifier.

Typically 0% of the total gasifying agent passes into the gasification chamber 320 underneath the end cap arrangement 50, a negligible amount along arrow 90, about 10% through the circumferential outlet underneath the lower edges of the outer shield plates 84 in the layer or portion 82, about 20% through the similar outlet in the layer or portion 80, about 30% through the similar outlet in the layer of portion 78, and about 40% through the similar outlet in the layer or portion 76. The gasification agent also serves to cool the grate components, such as the outer shield plates 84, as it passes through the rotating grate component 43.

The ash withdrawal proportions through the passageways 102, 114 and the gasification agent proportions through the various outlets, as given above, are balanced according to the annular cross-sectional areas immediately above the agent outlets and the ash discharge passageways.

When the grate 40 is rotated, the finger formation 500 disturbs the ash bed and in particular any hang-ups against the grate 40 and/or against the skin 316, resulting in the opening up of the fuel bed. Homogenisation of the ash and coal throughout the cross section of the fuel bed leads to improved steam and oxygen distribution, increased gasifier stability as a result of the reduction of preferential flow paths and hot spots and it is expected that it may also lead to lower $CO_2$ in the gasifier product gas. The use of the finger formation 500 unexpectedly addresses the problem of thermal extremes in the upper region of the gasifier. This is believed to be due to the bed homogenisation effect of the finger formation 500. The beneficial effect of the use of the finger formation 500 is further enhanced by specifically targeting areas of high flow resistance in the coal bed by distributing the gasification agent to these areas, as described hereinbefore. Thus, in contrast to known gasifier operations, a substantial portion of the gasification agent is now fed into the coal bed closer to the skin 316 to penetrate the outer ring of fine coal in the near jacket zone 404.

By, amongst others, controlling the rate of ash withdrawal, the interface (not shown) between a coal ash bed located towards the bottom of the chamber 320 and the coal bed which will thus be located above the interface, is maintained at a desired position. A fire bed thus constitutes this interface.

Ideally, for good gasifier control, the fire bed should be in a more-or-less horizontal line across the gasification zone, thereby indicating uniform mass flow withdrawal of ash across the entire radial cross-section of the gasification chamber 320, i.e. uniform ash withdrawal with uniform ash particle velocity. In other words, the fire bed profile should, ideally, be stable, flat and in equilibrium. There should be no vertical movement or displacement of the fire bed, i.e. it should be located in a fixed position within the gasifier, and the fire bed thickness should be uniform across the gasification zone. The gasification agent should, ideally, move upwardly on a mass flow basis, i.e. be distributed uniformly throughout the radial cross-section of the reactor and have a uniform velocity throughout the cross-section.

With the grate 40, the fire bed profile is stable and symmetrical, being of flattened W-shape. In other words, it has an equilibrium profile. The fire bed level moves within a restricted narrow vertical band and hence is stable, while it is of relatively uniform thickness. The gasification agent is distributed upwardly on an approximated mass flow basis, while ash extraction similarly takes place on an approximated mass flow basis downwardly, when about 20% of the ash is removed through the passageway 114 and about 80% thereof through the passageway 102. It is believed that up to six of the outer ploughs 100 can be used while up to four of the stationary ploughs 60 can be used. Still further, the outer surface of the grate component 43, as provided by the shield plates 84, is about 55° to the horizontal, i.e. greater than the angle of repose of ash. This promotes ash, which abuts the shield plates 84, moving downwardly towards the periphery to be removed by the ploughs 100 rather than creating stagnant zones.

With the grate 40, there are relatively large forces driving the ash downwardly and inwardly in the region of the ploughs 100, 60, while there are relatively small forces driving ash upwardly and over the ploughs, resulting in less wear on the ploughs and the outer shield plates 84. Additionally, the wear is spread over all the shield plates, and there is a lower propensity for wear due to the fact that 20% of the ash passes through the ash passageway 114 and thus does not pass over the wear plates 84.

It is believed that with the grate 40, and with which peripheral as well as central ash extraction is effected, effective primary crushing, in which clinkers are crushed in stages, are effected, due to the grate angle being greater than the angle of repose of ash. This applies to both the inner or central breaker rings 94, as well as the outer breaker or crusher rings constituted by the 'layers' 76, 78, 80 and 82 of outer shield plates 84. Additionally, there is no 'dead zone' between the angle of repose of ash and the grate surface angle, since the grate angle, typically about 55° to horizontal, is greater than the angle of repose of ash which is about 35° to the horizontal. The breaker rings are thus placed positively into the active or live ash region of the ash bed. Little, if any, ash arching and clinker bridging are experienced, resulting in little or no difference between the theoretical ash withdrawal velocity and the actual ash withdrawal velocity. With the grate 40, gasification agent distribution is substantially more uniform, and there is thus a more uniform upward velocity component of the fire bed, due to the agent being distributed in a less segregated mass flow moving ash bed which is homogenised by the finger formation 500.

Figure 8:
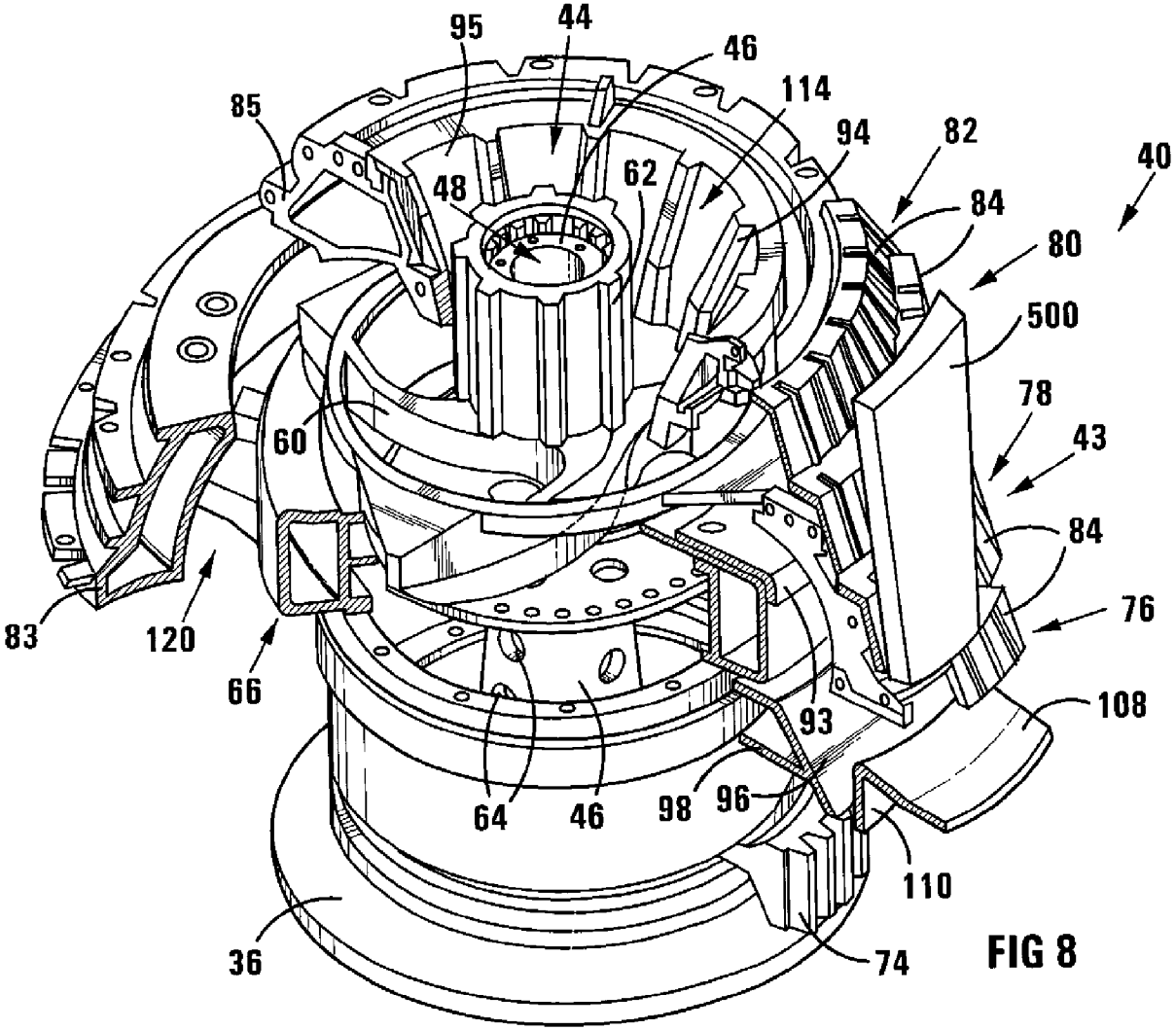
FIG. 8 shows, in part section, a three-dimensional view of the grate of FIG. 7, with portions omitted for clarity.
Figure 9:
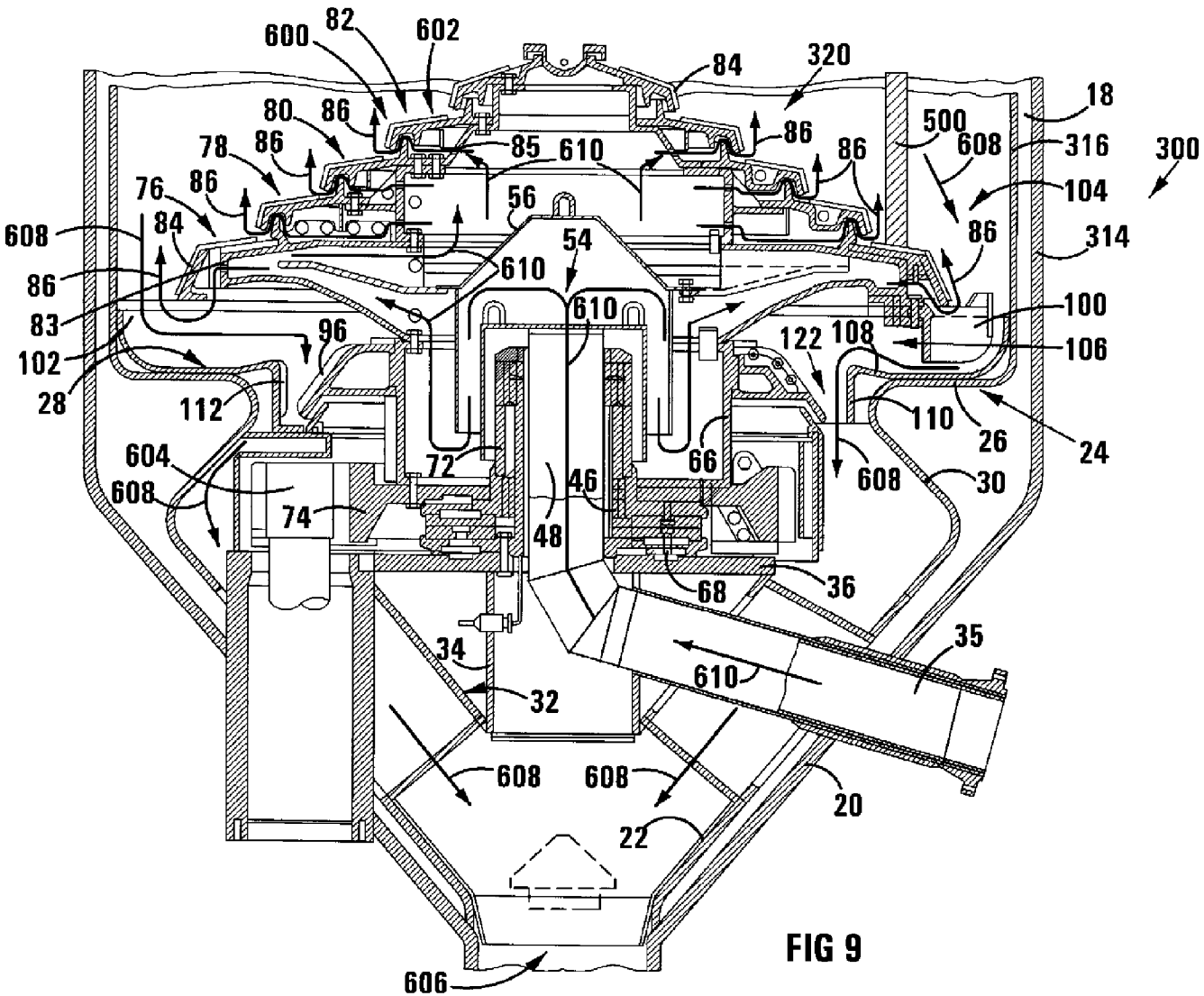
FIG. 9 shows a vertical sectional view of part of the fixed bed coal gasifier of FIG. 1 or FIG. 5, with a different grate.

Referring to FIG. 9 of the drawings, the gasifier 300 is shown with a grate 600 which differs in some respects from the grate 40 shown in FIGS. 7 and 8. Many of the features of the grate 600 are the same as or similar to the features of the grate 40 and where possible, the same reference numbers have thus been used to indicate the same or similar parts or features.

Instead of the first outer rotatable grate component 43 that forms part of the grate 40, the grate 600 includes a rotatable grate component 602 which is the only rotatable grate component. For the grate 600, there is thus no second stationary inner grate component 44.

In FIG. 9, a pinion gear 604 and an ash outlet 606 are shown. These features are not shown in FIGS. 7 and 8.

As a result of the absence of the second stationary grate component 44, the gasifier 300 shown in FIG. 9 has only one ash discharge passageway 102 and not a second ash discharge passageway 114. The protective cap 56 does not close the passageway 48. Instead, the outlet 54 is open to allow gasification agent to flow through the conduit 35 and the passageway 48 into the hollow interior of the rotatable grate component 602, as shown by arrows 610. Unlike the grate 40, the grate 600 does not have gasification agent passageways 64 in the pillar 46.

In use, the grate component 602 is rotated anti-clockwise. Coal is fed batchwise into the top of the gasifier 300 and gasification agent is fed into the bottom of the reaction zone through the gasification agent outlets underneath the lower edges of the outer shield plates 84 as hereinbefore described, thereby to gasify coal located in a slow moving bed within the gasification chamber 320. Ash is continuously withdrawn from the bottom of the gasification zone by the rotation of the rotatable grate component 602 which leads to the ploughs 100 continually rotating and discharging ash through the ash discharge passageway 102. The flow of ash is indicated by the arrows 608 in FIG. 9. As the grate component 602 rotates, clinker crushing is performed between the shield plates 84 and the skin 316, and between the breaker ribs 96 and 112.

Typically, about 10% of the total gasification agent passes into the gasification chamber 320 underneath the lower edges of the outer shield plates 84 in the layer or portion 82, about 20% from underneath the layer or portion 80, about 30% from underneath the layer or portion 78 and about 40% from underneath the layer or portion 76. During rotation of the grate component 602, the finger formation 500 disturbs the ash bed, leading to improved gasifier operation as hereinbefore described.

As with the grate 40, when the grate 600 is rotated, the finger formation 500 disturbs the ash bed and in particular any hang-ups against the grate 600 and/or against the skin 316, resulting in the opening up of the fuel bed. Homogenisation of the ash and coal throughout the cross section of the fuel bed leads to improved steam and oxygen distribution, increased gasifier stability as a result of the reduction of preferential flow paths and hot spots and it is expected that it may also lead to lower $CO_2$ in the gasifier product gas. The use of the finger formation 500 unexpectedly addresses the problem of thermal extremes in the upper region of the gasifier. This is believed to be due to the bed homogenisation effect of the finger formation 500. The beneficial effect of the use of the finger formation 500 is further enhanced by specifically targeting areas of high flow resistance in the coal bed by distributing the gasification agent to these areas, as described hereinbefore. Thus, in contrast to known gasifier operations, a substantial portion of the gasification agent is now fed into the coal bed closer to the skin 316 to penetrate the outer ring of fine coal in the near jacket zone 404.

The invention claimed is:

1. A counter-current fixed bed coal gasifier, which includes an upright cylindrical wall defining a coal gasification chamber in which coal, in the form of a fixed coal bed, can be gasified to produce synthesis gas as well as ash in an ash bed below the coal bed;

a coal lock above the chamber, the coal lock having a centrally located coal discharge opening which is in communication with the coal gasification chamber and a displaceable closure member for closing off the coal discharge opening, the closure member being displaceable between a closed position in which it closes off the coal discharge opening and an open position in which the coal discharge opening is uncovered or open so that coal can pass under gravity from the coal lock through the coal discharge opening into the coal gasification chamber;

a static coal distribution device inside the coal gasification chamber, the static coal distribution device including a hollow coal distributor having an upper open end spaced from the coal discharge opening and which flares downwardly outwardly from its upper end to a lower open end thereof and with no static coal distribution device being provided between the upper end of the coal distributor and the coal discharge opening other than the closure member; a skirt with an open upper end depending downwardly from the inside of the coal distributor so that a gas collection zone is defined between the skirt and the coal distributor, with the top of the gas collection zone being closed off while the bottom thereof is in communication with the coal gasification chamber; and at least one gas outlet in the coal distributor, with the gas outlet being in communication with the gas collection zone, a first coal passageway thus being defined between the coal distributor and the cylindrical wall while a second coal passageway is provided along and defined by the inside of the skirt;

a gas withdrawal conduit leading from the gas outlet of the coal distribution device through the wall of the coal gasification chamber;

an ash discharge outlet leading from the chamber at a low level; and a rotatable grate above the ash discharge outlet, the rotatable grate including at least one upwardly projecting finger or disturbing formation to disturb the ash bed formed in use above and around the rotatable grate, when the rotatable grate is rotated.

2. The gasifier as claimed in claim 1, in which the rotatable grate has a vertical dimension and a radial direction and is rotatable about a vertical axis of the ash discharge outlet, with a lower periphery of the rotatable grate being below an apex or upper end of the rotatable grate and with the finger formation being spaced from the axis of rotation of the rotatable grate.

3. The gasifier as claimed in claim 2, in which the finger formation projects upwardly to approximately the same height or slightly below the apex or upper end of the rotatable grate.

4. The gasifier as claimed in claim 1, in which the rotatable grate has an upwardly inwardly tapering outer surface which is staggered or stepped when seen in vertical cross-section, defining vertically and radially spaced terraces, the finger formation being located on the lowermost outermost terrace.

5. The gasifier as claimed in claim 4, in which the upwardly inwardly tapering outer surface of the rotatable grate is defined by a rotatable grate component, the gasifier thus including said rotatable grate component in the coal gasification chamber, with a first annular portion of an ash discharge passageway being provided between the wall of the gasification chamber and the rotatable grate component, with the grate component being rotatable about the vertical axis of the ash discharge passageway, and with the grate component being adapted so that clinker crushing is, in use, effected in the first annular portion of the ash discharge passageway as the grate component rotates;

a stationary support component at a lower end of the first annular portion of the ash discharge passageway, the stationary support component providing or defining an ash collection surface; and at least one primary scraper adapted to urge ash on the ash collection surface of the support component inwardly or outwardly along a second portion of the ash discharge passageway, as the grate component rotates, with the ash discharge passageway being adjacent a floor of the gasification chamber.

6. The gasifier as claimed in claim 5, in which the rotatable grate includes four circumferential gasification agent outlets which are vertically and radially spaced, ranging from a highest, radially innermost to a lowest, radially outermost gasification agent outlet and including a second highest and a third highest outlet.

7. The gasifier as claimed in claim 6, in which the gasification agent outlets are dimensioned to release gasification agent at a common supply pressure in the following proportions:

Lowermost, radially outermost: 30% to 50%
Third highest: 20% to 40%
Second highest: 10% to 30%
Highest, radially innermost: 5% to 15%.

8. A method of operating a fixed bed coal gasifier as claimed in claim 1, the method including feeding coal into the coal gasification chamber through the coal lock and distributing the coal inside the coal gasification chamber by means of said coal distribution device to form a fixed coal bed;

feeding a gasification agent into the gasification chamber;

gasifying the coal in the gasification chamber to produce synthesis gas as well as ash in an ash bed below the coal bed; and rotating said rotatable grate to remove ash through the ash discharge outlet and to disturb the ash bed with said at least one finger or disturbing formation.

9. The method as claimed in claim 8, in which the rotatable grate includes a grate component, which has an outer surface which is staggered or stepped in vertical cross-section, with a circumferential gasification agent outlet being provided at least some steps or layers, the gasification agent outlets thus being vertically and radially spaced, the method further including feeding the gasification agent into the gasification chamber through the circumferential gasification agent outlets, including a bottom radially outermost gasification agent outlet on the bottom radially outermost step or layer.

10. The method as claimed in claim 9, in which the gasification agent is fed in proportion to the radial position of a gasification agent outlet, with the radially outermost gasification agent outlet thus feeding the most gasification agent and a radially innermost gasification agent outlet feeding the least of the gasification agent.

11. The method as claimed in claim 10, in which the rotatable grate includes four circumferential gasification agent outlets which are vertically and radially spaced, ranging from a highest, radially innermost to a lowest, radially outermost gasification agent outlet and including a second highest and a third highest outlet.

12. The method as claimed in claim 11, in which the gasification agent is fed through the outlets in the following proportions:

Lowermost, radially outermost: 30% to 50%
Third highest: 20% to 40%
Second highest: 10% to 30%
Highest, radially innermost: 5% to 15%.

13. A fixed bed coal gasifier, which includes an upright cylindrical wall defining a coal gasification chamber in which coal, in the form of a fixed coal bed, can be gasified to produce synthesis gas as well as ash in an ash bed below the coal bed;

a coal lock above the chamber, the coal lock having a centrally located coal discharge opening which is in communication with the coal gasification chamber and a displaceable closure member for closing off the coal discharge opening, the closure member being displaceable between a closed position in which it closes off the coal discharge opening and an open position in which the coal discharge opening is uncovered or open so that coal can pass under gravity from the coal lock through the coal discharge opening into the coal gasification chamber;

a static coal distribution device inside the coal gasification chamber, the static coal distribution device including a hollow coal distributor having an upper open end spaced from the coal discharge opening and which flares downwardly outwardly from its upper end to a lower open end thereof and with no static coal distribution device being provided between the upper end of the coal distributor and the coal discharge opening other than the closure member; a skirt depending downwardly from the inside of the coal distributor so that a gas collection zone is defined between the skirt and the coal distributor, with the top of the gas collection zone being closed off while the bottom thereof is in communication with the coal gasification chamber; and at least one gas outlet in the coal distributor, with the gas outlet being in communication with the gas collection zone, a first coal passageway thus being defined between the coal distributor and the cylindrical wall while a second coal passageway is provided along the inside of the skirt;

a gas withdrawal conduit leading from the gas outlet of the coal distribution device through the wall of the coal gasification chamber;

an ash discharge outlet leading from the chamber at a low level; and a rotatable grate above the ash discharge outlet, the rotatable grate including at least one upwardly projecting finger or disturbing formation to disturb the ash bed formed in use above and around the rotatable grate, when the rotatable grate is rotated;

in which the rotatable grate has an upwardly inwardly tapering outer surface which is staggered or stepped when seen in vertical cross-section, defining vertically and radially spaced terraces, the finger formation being located on the lowermost outermost terrace; and in which the upwardly inwardly tapering outer surface of the rotatable grate is defined by a rotatable grate component, the gasifier thus including said rotatable grate component in the coal gasification chamber, with a first annular portion of an ash discharge passageway being provided between the wall of the gasification chamber and the rotatable grate component, with the grate component being rotatable about the vertical axis of the ash discharge passageway, and with the grate component being adapted so that clinker crushing is, in use, effected in the first annular portion of the ash discharge passageway as the grate component rotates;

a stationary support component at a lower end of the first annular portion of the ash discharge passageway, the stationary support component providing or defining an ash collection surface; and at least one primary scraper adapted to urge ash on the ash collection surface of the support component inwardly or outwardly along a second portion of the ash discharge passageway, as the grate component rotates, with the ash discharge passageway being adjacent a floor of the gasification chamber.

14. The gasifier as claimed in claim 13, in which the rotatable grate includes four circumferential gasification agent outlets which are vertically and radially spaced, ranging from a highest, radially innermost to a lowest, radially outermost gasification agent outlet and including a second highest and a third highest outlet.

15. The gasifier as claimed in claim 14, in which the gasification agent outlets are dimensioned to release gasification agent at a common supply pressure in the following proportions:

Lowermost, radially outermost: 30% to 50%
Third highest: 20% to 40%
Second highest: 10% to 30%
Highest, radially innermost: 5% to 15%.

* * * * *